United States Patent [19]

Ignell

[11] Patent Number: 4,819,710

[45] Date of Patent: Apr. 11, 1989

[54] ARRANGEMENT FOR CONTINUOUS CASTING A VERY THIN METAL FILM

[75] Inventor: Rolf Ignell, Chemin de Mourex, France

[73] Assignee: Roby Teknik AB, Lund, Sweden

[21] Appl. No.: 98,236

[22] Filed: Sep. 18, 1987

[30] Foreign Application Priority Data

Oct. 7, 1986 [SE] Sweden ..... 8604250

[51] Int. Cl.[4] ..... B22D 11/06

[52] U.S. Cl. ..... 164/423; 164/429

[58] Field of Search ..... 164/423, 429, 463, 479

[56] References Cited

U.S. PATENT DOCUMENTS 3,863,700 2/1975 Bedell et al. ..... 164/423 X 4,170,257 10/1979 Pond, Sr. et al. ..... 164/423 X 4,614,220 9/1986 Savage ..... 164/479 X

*Primary Examiner*—Fred A. Silverberg

*Assistant Examiner*—J. Reed Batten, Jr.

*Attorney, Agent, or Firm*—Kinney & Lange

[57] ABSTRACT

An arrangement for the manufacture of a thin, in particular very thin (such as 5–50 micron), metal film (6) by cooling of molten metal or metallic alloy, this arrangement comprising a driven endless band (10) serving as casting substrate and a rotating roll (20) arranged closely adjoining the band (10) which is intended to be partially immersed in a bath (5) of the molten material for the pickup and transfer of the molten material from the bath (5) to the band (10) passing by for cooling so as to form the thin metal film (6).

8 Claims, 3 Drawing Sheets

ARRANGEMENT FOR CONTINUOUS CASTING A VERY THIN METAL FILM

Figure 1:
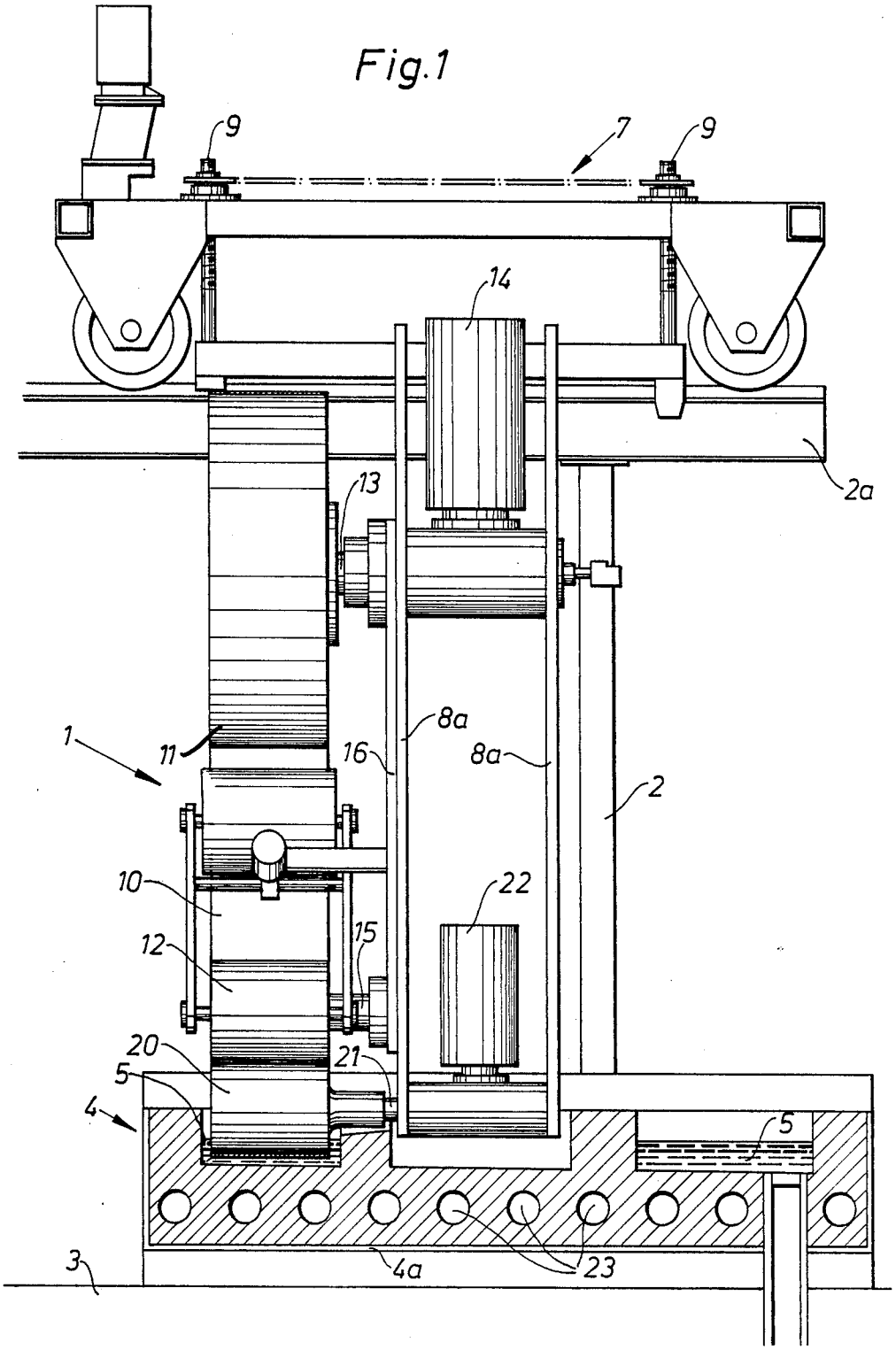

The present invention relates to the manufacture of thin, in particular very thin, metal films, and relates more particularly to an arrangement for the manufacture of such a thin film from molten metal or metallic alloy, this arrangement comprising a movable, cooled support and means for applying the molten material to the support for cooling so that the thin metal film may be formed.

Thin metal films with thicknesses such as 5–50 micron are used in many technical contexts for diverse differing purposes. Among other things, thin metal films are useful in electrical engineering as a winding material for transformer cores, and in connection with welding as so-called brazing foils. The thickness of metal films for the applications mentioned here varies from case to case, but generally keeps within the 5–50 micron range. Somewhat thicker films, for example, such as 30–50 micron, are required for electrotechnical applications.

The metal films are manufactured conventionally by so-called rapid solidification of the molten metal or metallic alloys furnished, and depending on the shape of the die used it has been possible to manufacture thin extruded wires, bands, straps and broader foils as required.

Arrangements for the manufacture of, for example a thin metal foil in accordance with the known technique are described, inter alia, in U.S. Pats. Nos. 4,212,343 and 4,433,715, as well as also in many other patents. These known arrangements typically comprise a movable, cooled support and an extrusion die directed towards the support having a slotlike aperture in connection with a pressurized source for the molten material, and the manufacture of the metal film occurs for example so that the molten material under the effect of its own gravity and a gas pressure applied over the melt is extruded through the slotlike die onto the movable support for cooling so as to form the metal film which is drawn off and rolled up on a roll in connection with the arrangement.

It is also known that certain molten metallic alloys on sufficiently rapid cooling (such as $10^{5}$–$10^{6}$° C./s) acquire an amorphous (random, non-crystalline) structure of almost glasslike character, and a metal film of such amorphous structure has a series of important advantageous properties (e.g. tensile strength) which make it clearly superior to a corresponding more crystalline metal film for utilization in contexts which demand specially strong material so as to withstand the stresses which may occur.

The known arrangements have several serious disadvantages. Among other things the die, after a relatively short operating period, tends to get choked up by incrustations which build up on the die walls and which to a particularly high degree depend upon the purity of the starting material used for the melt, that is to say the more contaminated the starting material the greater will be the danger of incrusted contaminations following into the melt and choking up the die. To prevent operating disturbances caused by choked up dies the conventional arrangements require, consequently, that the molten starting material should be as pure as possible, but this, on the other hand, means increased production costs.

The die, moreover, is susceptible to changes in shape owing to heat corrosion.

On the assumption that suitable (clean) starting material is used it is thus possible to carry out the method (planar flow casting) relatively free of trouble by means of the known arrangements described here, but this is true only as long as the width of the slotlike die aperture does not exceed the limit value beyond which it is very difficult and almost impossible in practice to maintain the necessary critical conditions (such as constant temperature, rate of flow, etc.) along the whole slot width as it is required for the manufacture of thin metal foils with identical and uniform quality characteristics. For the manufacture of wider metal foils in accordance with known technique it is necessary for the feed of melt to take place by means of a number of dies arranged close to one another (multiple die system) whose size and number in each individual case is determined by the desired width of the metal foil produced, but this means, of course, that the risk of incrustation and choking up increases to a corresponding degree.

It is an object of the present invention, therefore, to provide the state of the art with an improved arrangement of the type described in the introduction for the manufacture of a thin metal film from molten metal or metallic alloy.

It is another object to bring about such an arrangement which has greater operational reliability than the known arrangements equipped with dies.

Furthermore it is an object of the invention to bring about an arrangement by means of which it is possible to manufacture thin metal films from molten metal or metallic alloy without limitation inasfar as the choice of starting material for the molten metal or metallic alloy is concerned.

It is yet another object to bring about an arrangement for the manufacture of thin, amorphous metal films with homogeneous and uniform quality characteristics and widths as required.

In accordance with the present invention these objects are achieved in that an arrangement of the type mentioned earlier is given the characteristic that the said means for applying the molten material to the support comprises a rotating roll arranged closely adjoining the support, which is intended to be partially immersed in a bath of the molten material so as to allow transfer of this material from the bath to the support.

Figure 2:
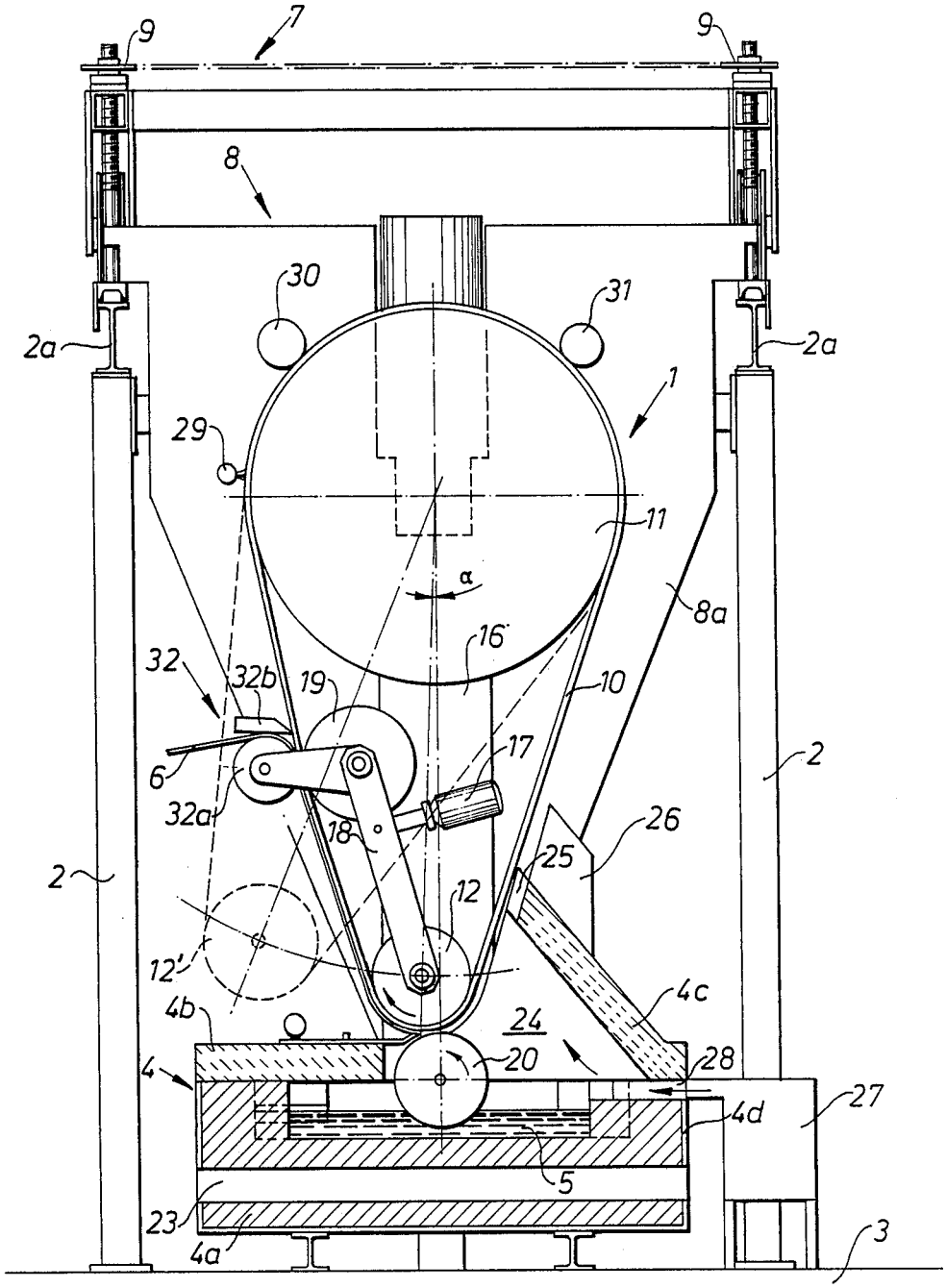
Figure 3:
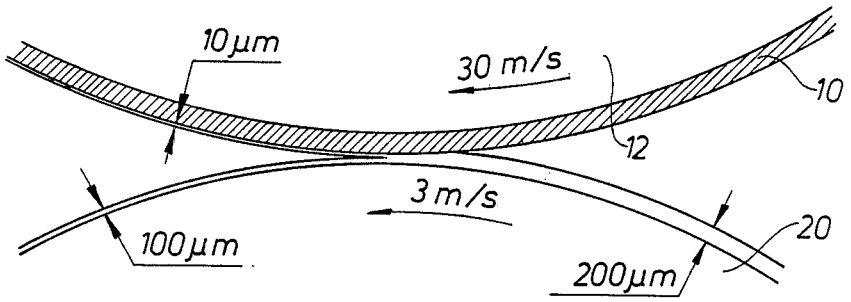

The invention will be described in more detail in the following with reference to the attached drawings wherein FIG. 1 is a schematical lateral view of a practically preferred embodiment of an arrangement in accordance with the present invention, FIG. 2 is a corresponding schematic view of the arrangement seen from the front, and FIG. 3 illustrates on a somewhat enlarged scale a process detail during the utilization of the arrangement in FIGS. 1 and 2.

The arrangement shown (generally marked 1 in FIGS. 1 and 2) in accordance with the invention is supported with the help of a frame 2 on a firm base 3 in connection with an open vat 4 containing a heated bath 5 of molten starting material, e.g. iron alloy for the manufacture of a thin metal film 6.

Above the stand 2 is arranged a trolley 7 which is movable along horizontal parts of the stand or rails 2a above the vat 4 and which supports a holder arrangement 8, consisting of suspended plates **8*a* connected with each other, for the actual arrangement 1 in accordance with the invention. The plates 8***a* preferably are mounted on the trolley 7 with the help of an appropriate lifting mechanism 9 so that they can be raised and lowered in order to make possible a correct adjustment of the height of the arrangement 1 in relation to the bath 5 in the vat 4 below the movable trolley 7.

As is evident from FIGS. 1 and 2 the arrangement 1 comprises a driven endless band 10 which runs free from slippage in a vertical loop around rotating rolls 11 and 12, the upper roll 11 of which is mounted on a horizontal axle 13, supported by the plates 8*a* so that it can rotate, and adapted to be driven with the help of a suitable driving arrangement 14, e.g. an electric motor, for the rotation of the roll 11. The bottom roll 12 is adapted so that it can rotate on a horizontal axle 15 which is supported by means of an arm 16 mounted so that it can swing about the axle 13 in order to make possible a swinging out of the roll 12 and the band 10 to the inactive position indicated by broken lines at 12' in FIG. 2, which will be explained later on.

The arm 16 also supports a compressed air-operated piston 17 which is adapted to act upon arms 18 mounted so that they can swing on the axle 15 and support at the top a rotating band tension roll 19 pressed against the band 10.

The fixed plates 8a support at the bottom centrally underneath the upper roll 11 a further roll 20 rotating closely adjoining the band 10 which is supported on a horizontal axle 21 mounted so that it can rotate in the plates 8a and adapted to be driven with the help of a suitable driving device 22, e.g. an electric motor. The roll 20 is intended to be partially immersed in the heated bath 5 during the operation of the arrangement for the pick up and transfer of the molten material, as is evident from FIG. 3

As mentioned earlier it is important that the bath 5 should be kept at a constant, sufficiently high temperature so as to keep the melt liquid, and this is achieved in accordance with the invention with the help of heating means provided in the vat 4, e.g. gas firing where the flue gases are conducted into passages 23 in the bottom wall 4*a* of the vat designed for the purpose, which permanently provide the amount of heat required for maintaining the bath at the desired temperature.

The vat 4, as is evident from FIG. 2, is partially covered at the top by refractory blocks 4*b* and 4*c*, one of which, 4*c*, is slightly inclined in the region of the band 10 and is limited on both sides of the later by vertical walls of the same material and is designed so that in co-operation with the band 10, the roll 20, the bath 5 and the vat 4 a practically completely closed chamber 24 is formed. The length of the partially inclined block 4*c* is preferably adjusted so that the upper end of the block terminates at a very short distance from the band 10 passing by so as to form a very narrow, gaplike opening 25 into the chamber 24 between the band 10 and the upper end of the block 4c. To minimize the risk of the phenomenon, known by those versed in the art, of so-called air pockets between the band 10 and the molten material picked up during the passage between the rolls 12 and 20, it is important for the air layer carried along closely adjoining the moving band 10 to be of a density which is as low as possible, and it is known, inter alia, in accordance with well-known thermodynamic connections that the density of such an interface is temperature-dependent and more particularly in such a way, that is decreases with rising temperature. A certain amount of heating of the air layer occurs of course owing to the passage through the chamber 24 heated by the bath 5, but it can be improved further in accordance with the invention by the installation of a discharge device 26, e.g. a blower 26 arranged on the outside of the block 4c whose suction side communicates with the gaplike opening 25 thus forcing the heated gas to escape from the chamber 24 through the opening 25 in close contact with the band 10 passing by in counterflow. According to any particular requirements the gas temperature in the chamber 24 can be raised further with the help, for example, of a reducing gas flame (at 27) the flame being directed into the chamber 24 through a blow-in duct 28 provided in one side wall 4d of the vat 4, as a result of which the density of the gas layer can be further lowered.

As has been mentioned earlier it is a precondition for the manufacture of thin metal films of amorphous structure that the cooling of the molten material on the movable band 10 should take place very rapidly, that is to say at a cooling rate in the order of magnitude of $10^4$–$10^6$ °C./s, and it is an important precondition for such a rapid cooling to be possible, that the contact (from a point of view of heat transfer) between the molten material and the cooled band 10 must be sufficiently good. This means that the band surface must be clean and above all smooth, and in accordance with the invention the arrangement 1 is provided, therefore, with a number of cleaning means comprising a reducing gas flame (at 29), a rotating steel brush 30 and a polishing brush 31 in direct connection with the upper cooled roll 11.

The roll 11 is provided preferably with an internal flow system (not shown) in association with an appropriate external source of cooling fluid which is passed through this system for the cooling of the roll 11 and thereby of the band 10 passing by. Since the band 10 is intended to be driven at very high speed, such as 10–50, e.g. 30 m/s, the roll 11 preferably has a very large diameter so as to furnish the band with a sufficiently long sojourn time in contact with the surface of the cooled roll 11 to ensure the necessary cooling of the band.

When the arrangement 1 is to be used for the manufacture of a thin, amorphous metal film of a thickness of 5–50, e.g. 10 micron, the work is carried out in the manner which will now be described with special reference to FIG. 3. The trolley 7 is moved so that the plates 8*a* (with the roll 12 in the swung-out position at 12') are adjusted straight above the vat 4 and are lowered to the position shown, whereafter the band 10 and the roll 20 are started. The band 10 is assumed in this example to be driven at a speed of 30 m/s, and it is further assumed that the roll 20 is driven at a peripheral speed corresponding to 3 m/s. The rotating roll 20 is now partially immersed in the heated bath 5 of the molten material. The depth of immersion is appropriately about 20–35% of the diameter of the roll 20. The roll 20 will pick up an adhering layer of molten material, and when a certain desired constant layer thickness (e.g. 200 micron) and stable temperature conditions have established themselves, the roll 12 is swung in so that it is substantially straight above, or at an angle ($\alpha$) slightly inclined to the left of, the roll 20 and so that the distance between the band 10 passing by and the surface of the roll 20 amounts to approx. 100 micron. As a result the band 10 will pass between the rolls 12 and 20 partially immersed in the picked up adhering layer of molten material on the surface of the roll 20, so that a transfer of this to the band 10 takes place. The thickness of the molten material so transferred to the band 10 is determined, inter alia, by the speed ratio between the band 10 and the roll 20, and in the example chosen here this amounts to 10 micron. The residue of molten material on the surface of the roll 20 accompanies the roll 20 back into the bath 5. The molten material layer transferred is cooled on the band 10, which has been cooled on its passage around the cooled roll 11, at a cooling rate of $10^5$–$10^6$°C./s, as a result of which this layer solidifies rapidly to form the amorphous metal film. The metal film is then drawn off with the help of a drawing off arrangement 32 provided close to the band 10 comprising a rotating drawing off roll 32*a* in cooperation with a stripping device 32*b* and is wound up on a rewinding roll (not shown). After the passage past the drawing off arrangement 32 the band 10 continues around the roll 11 for cleaning and cooling and further back to the rolls 12 and 20 via the narrow opening 25 into the chamber 24 for renewed pickup of molten material from the surface of the roll 20.

I claim:

1. An arrangement for the manufacture of a thin, in particular very thin, film (6) from a molten metal or metallic alloy in a bath (5), the arrangement comprising:

a holder arrangement (8) located above the bath (5), the holder arrangement (8) adapted to be raised and lowered;

an upper rotating roll (11) and a lower rotating roll (12) supported by the holder arrangement (8);

a driven endless band (10) connecting the rotating rolls (11, 12), the band (10) serving as a movable, cooled support; and a third rotating roll (20) supported by the holder arrangement (8), the third roll (20) arranged partially immersed in the molten metal or metallic alloy in the bath (5) and closely adjoining the endless band (10), below the lower rotating roll (20), wherein the third roll (20) makes possible a transfer of the metal or metallic alloy from the bath (5) to the endless band (10) for cooling, so as to form the thin film (6).

2. An arrangement in accordance with claim 1, characterized in that the lower roll (12) is adapted so that it can be swung out to allow a disengagement of the band (10) from the third roll (20).

3. An arrangement in accordance with claim 1, the bath (5) being installed in a vat (4) partially covered at the top by blocks (4*b*) and (4*c*), characterized in that one of the blocks (4*c*) is partially inclined so as to form in co-operation with the band (10), the third roll (20) and the bath (5) a practically completely closed chamber (24) in direct connection to the nip between the lower and third rolls (12) and (20) arranged adjoining one another.

4. An arrangement in accordance with claim 3, characterized in that the inclined block (4*c*) is adapted so as to terminate at a very short distance from the band (10) passing by in order to form a narrow, gaplike opening (25) into the chamber (24) between the block (4c) and the band (10).

5. An arrangement in accordance with claim 4, characterized in that a discharge device (26) is arranged directly connected to the gaplike opening (25) adapted to exhaust heated gas from the chamber (24) in counterflow contact with the band (10) passing through the opening (25).

6. An arrangement in accordance with claim 3, characterized in that the one side wall (4*d*) of the vat (4) is provided with a through-going duct (28) in connection with an external reducing gas flame (27), the flame being directed into the duct (28) for blowing the gas into the chamber (24).

7. An arrangement in accordance with claim 1, characterized in that the holder arrangement (8) comprises suspended plates (8a) connected with each other which are mounted at the top so that they can be raised and lowered on a movable trolley (7) supported on a stand (2).

8. An arrangement in accordance with claim 7, characterized in that the trolley is supported so that it can roll on horizontal parts of the stand or rails (2*a*) above the vat (4).

* * * * *

UNITED STATES PATENT AND TRADEMARK OFFICE

CERTIFICATE OF CORRECTION

PATENT NO. : 4,819,710

DATED : April 11, 1989

INVENTOR(S) : Rolf Ignell

It is certified that error appears in the above-identified patent and that said Letters Patent is hereby corrected as shown below:

On the title page add:

U.S. PATENT DOCUMENTS

| | | | |
|---|---|---|---|
| 4,326,579 | 4/1982 | Pond, Sr. et al. | .....164/423X |
| 4,341,260 | 7/1982 | Ishibachi et al. | .....164/463 |

FOREIGN PATENT DOCUMENTS

Translation of Japanese Oatent Publication 57-41856, published March 9, 1982.

Signed and Sealed this

Fourteenth Day of November, 1989

*Attest:*

JEFFREY M. SAMUELS

*Attesting Officer*

*Acting Commissioner of Patents and Trademarks*